US007992275B1

(12) United States Patent
Bekker et al.

(10) Patent No.: US 7,992,275 B1
(45) Date of Patent: Aug. 9, 2011

(54) METHOD FOR THRUSTER WITHDRAWAL FOR MAINTENANCE OR VESSEL TRANSIT WITHOUT THE NEED FOR AN EXTERNAL CRANE, REMOTE OPERATED VEHICLE, OR DIVER

(75) Inventors: Joannes Raymond Mari Bekker, Houston, TX (US); Sammy Russell Moore, Houston, TX (US)

(73) Assignee: Thrustmaster of Texas, Inc., Houston, TX (US)

( * ) Notice: Subject to any disclaimer, the term of this patent is extended or adjusted under 35 U.S.C. 154(b) by 0 days.

(21) Appl. No.: 12/884,077

(22) Filed: Sep. 16, 2010

(51) Int. Cl.
*B23P 6/00* (2006.01)
*B23P 19/04* (2006.01)
*B23P 23/00* (2006.01)

(52) U.S. Cl. ..... 29/402.03; 29/426.1; 440/54; 114/265

(58) Field of Classification Search ..... 29/402.01, 29/402.03, 426.1; 440/54, 65; 114/264, 114/265
See application file for complete search history.

(56) References Cited

U.S. PATENT DOCUMENTS 2,987,027 A * 6/1961 Wanzer ..... 114/122
3,483,843 A * 12/1969 Hawthorne ..... 440/54
4,066,034 A * 1/1978 Haglund ..... 440/111
4,066,035 A * 1/1978 Haglund et al. ..... 440/111
4,436,050 A 3/1984 Liden
4,580,517 A 4/1986 Lundberg
4,634,389 A * 1/1987 Eptaminitakis ..... 440/53
4,878,864 A 11/1989 Van Bentem
5,397,255 A * 3/1995 Heer ..... 440/54
5,403,216 A 4/1995 Salmi et al.
5,435,762 A * 7/1995 Reuter ..... 440/54
5,491,636 A 2/1996 Robertson et al.
6,067,697 A * 5/2000 Savikurki et al. ..... 29/426.1
6,247,421 B1 6/2001 Ludwigson
6,257,165 B1 7/2001 Danos, Jr. et al.
6,361,386 B1 * 3/2002 Savikurki et al. ..... 440/54
6,375,524 B1 * 4/2002 Commandeur et al. ..... 440/54
6,378,450 B1 4/2002 Begnaud et al.
6,439,936 B1 * 8/2002 Dreith et al. ..... 440/54
6,453,838 B1 9/2002 Mowell et al.
6,458,004 B2 * 10/2002 Van Breems ..... 440/6
6,668,746 B1 12/2003 Schia et al.
6,672,236 B1 1/2004 Pinsof
6,848,380 B1 2/2005 Sainz
6,848,382 B1 2/2005 Bekker
7,055,447 B1 6/2006 Bekker
7,641,526 B1 * 1/2010 Bekker ..... 440/54

* cited by examiner

*Primary Examiner* — David Bryant
*Assistant Examiner* — Christopher Koehler
(74) *Attorney, Agent, or Firm* — Buskop Law Group, PC; Wendy Buskop

(57) ABSTRACT

A method is disclosed herein for lifting thrusters on vessels enabling for on vessel maintenance at sea. The method can include engaging a thruster mounting flange with a thruster well bottom flange; installing alignment guide plates to provide a rough alignment; positioning a seal to provide a connection; installing fasteners to secure the flanges; actuating clamps to secure the flanges while compressing the seal; raising the thruster out of the thruster well; transporting the thruster to a deck of the floating vessel; actuating clamps to hold the flanges; removing the fasteners; flowing water into the thruster well; disengaging the clamps; and lifting the thruster with the lifting means.

20 Claims, 9 Drawing Sheets

METHOD FOR THRUSTER WITHDRAWAL FOR MAINTENANCE OR VESSEL TRANSIT WITHOUT THE NEED FOR AN EXTERNAL CRANE, REMOTE OPERATED VEHICLE, OR DIVER

FIELD

The present embodiments generally relate to a method for thruster withdrawal for maintenance or for vessel transit without the need of an external crane, a remote operated vehicle (ROV), or a diver.

BACKGROUND

A need exists for easily performing major maintenance on thrusters of deep draft vessels, such as drill ships, semi-submersibles, floating production platforms (FPSO), and other vessels because the thrusters extend below the bottom of the hull and are submerged in seawater at all times. Traditionally, maintenance has been performed by one of three ways.

Conventionally, for maintenance, the thrusters have been transported, attached to the vessel, to a dry dock, or to a graving dock. At the dry dock or graving dock, the vessel with the thrusters is taken out of the water. Problems exist with this conventional maintenance method and system because the vessel owners and operators lose vessel operating time as the vessel is out of service, and the use of the graving dock or dry dock is expensive.

The present embodiments provide a lower cost solution to this conventional maintenance system and method.

It has also been known to use divers or remote operated vehicles (ROV) beneath the floating vessel, which can lead to problems, in that the divers or the ROV's drop tools, are clumsy, and parts can be lost overboard. Special training is needed for the divers and for ROV operators.

The present embodiments no longer require the need for divers or ROV's to do underwater maintenance on thrusters.

The present embodiment reduce the risk of the occurrence of accidents that often occur when divers perform underwater maintenance on thrusters by eliminating or reducing the need for the divers.

The present embodiments meet these needs.

BRIEF DESCRIPTION OF THE DRAWINGS

The detailed description will be better understood in conjunction with the accompanying drawings as follows.

Figure 1A:
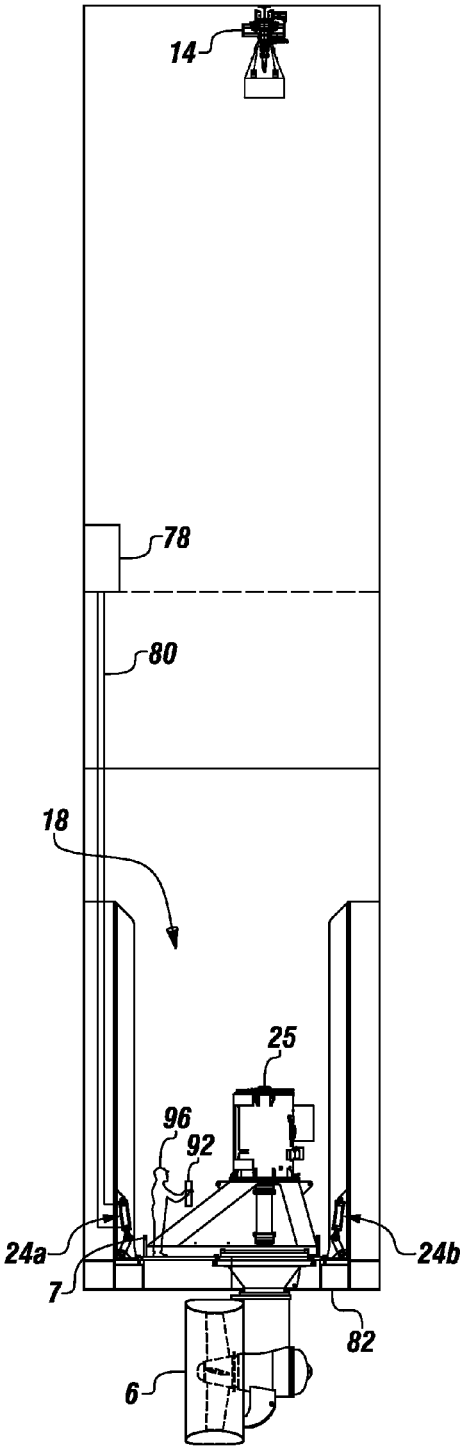
FIG. 1A is a first step of a sequence for lifting a thruster from the hull of a vessel using a thruster well.

The present embodiments are detailed below with reference to the listed Figures.

DETAILED DESCRIPTION OF THE EMBODIMENTS

Before explaining the present method in detail, it is to be understood that the method is not limited to the particular embodiments and that it can be practiced or carried out in various ways.

The present embodiments generally relate to a method to enable the lifting of thrusters from a vessel hull while a vessel is floating, such as at sea, for transit of the vessel or for repair of the thrusters without needing extra heavy lift cranes, remote operated vehicles, underwater divers, and without needing to return to shore.

One of the benefits of embodiments can be that the method can provide significant safety protection compared to commercial techniques for maintaining thrusters, such as diver dry suits and associated communication apparatus.

Another benefit of the method can be that no heavy lift crane is needed to maintain the thrusters, which can be dangerous when tendered along side a vessel in high seas, and can lead to accidently dropping the thruster into the sea or on people on a deck of a vessel. The method can use simple onboard cranes such as bridge cranes, or simple onboard monorails with connected moveable transport devices, to prevent the hazards associated with heavy lift cranes from tendered barge.

The method can be less expensive to implement than currently practiced methods. The method can save a vessel owner a daily rate of between $100,000 and $300,000 per day in 2010 US dollars, which is generally the cost of renting a heavy lift crane barge.

The method can provide additional safety features, such as redundant sealing of each thruster in a thruster well to the hull. The method can provide a level of increased safety in that test ports can be used to verify that the seals around each thruster are working.

The method can use a plurality of super strong holding clamps simultaneously to prevent mishaps that can occur with use of only one clamp, such that if one clamp fails the other clamps will hold. At least 20 percent more holding clamps can be used than are necessary to hold the thruster mounting flange to the thruster well bottom flange.

The method can be faster to implement than known techniques, in that the amount of time needed to implement the method can be only a matter of hours rather than a matter of days. Typical thruster repair methods can take from three days to one week. if the floating vessel is at sea. Conventionally, a floating vessel with positioning thrusters has to call for a heavy lift crane barge to drive up to the vessel, and to tender the thruster to the barge. The method can be implemented without the need to wait on performing maintenance due to weather that is preventing movement of the thruster to the barge.

The method can be more quickly implemented than traditional underwater thruster dismount techniques, and can require no operator in-water training on how to perform the method. All steps of the method can be performed on a surface of the vessel rather than in the water or subsea. The method can require less overall maintenance personnel training on underwater removal systems, therefore no extra wetsuits or dry suits are needed to implement one or more embodiments of the method. Extra equipment can be an added expense, and typically includes custom fitted dry suits, regulators, fins, gloves, and other diver communication equipment which can be expensive, such expenses can be avoided using the method disclosed herein.

The method can be more environmentally friendly and safer than known methods, as the method does not allow a thruster to be lost overboard where the thruster can leak oil into the ocean, such as when a heavy lift crane from a separate vessel is used to move the thruster. The thruster can be prevented from falling through an opening into the sea, which can happen when cranes lift a thruster from its floating vessel, over open ocean, and onto a waiting barge for transport to land for repair.

The method can enable an operator of the floating vessel to be independent from the outside assistance, even at sea, the operator can perform needed maintenance without additional assistance.

The method can be implemented on thrusters that are configured for removal and re-installation while the vessel is at maintenance draft, which can be ten meters lower than normal transit drafts. The method can therefore provide stability compared to removal at the shallower transit drafts, and can reduce the hoisting distance from the vessel bottom to the deck for maintenance.

The method can include installing a vertical well, also called "the thruster well" around each thruster from the bottom of the floating vessel.

The thruster well can extend upward away from the floating vessel bottom. The thruster well can be welded around the thrusters or the thruster can be installed with the well surrounding the thruster after the thruster well is connected to the vessel hull bottom on the inside of the vessel. The thruster well can have a single thruster well wall, such as if the well is round, but can also have a plurality of connected well walls, such as if the well has another shape, such as square or rectangular.

The method can include installing a thruster well with a thruster well bottom flange and a thruster mounting flange. The thruster mounting flange can engage with the thruster well bottom flange around a thruster that at least partially extends into water through a portion of the hull that can be under water.

The method for lifting a thruster can include using a hoist or another lifting means to engage a lifting eye on a thruster and on removable portions of the thruster, such as portions of the thruster that can be harmed if disposed under water. The method can include lifting up the thruster using a lifting eye.

The method can include installing a plurality of alignment guide plates concentrically around the thruster in the thruster well. The installation can include installing the alignment guide plates to extend from proximate the thruster well bottom flange to a thruster well wall top, and allowing for a rough alignment of the thruster mounting flange to the thruster well bottom flange using the alignment guide plates.

The method include positioning at least one seal adjacent the thruster mounting flange for providing a water tight connection between the thruster well bottom flange and the thruster mounting flange. The seal can be one or possibly two concentric o-flanges that can be compressible by the clamps forming a water tight seal.

In embodiments, the at least one seal can engage one of a plurality of concentric seals concentric to the first seal, thereby allowing for a plurality of sealing engagements around the thruster mounting flange. Such an arrangement can be used to redundantly provide a water tight connection between the thrusters well bottom flange and the thruster mounting flange.

The method can include installing a plurality of fasteners to secure the thruster mounting flange to the thruster well bottom flange while compressing the at least one seal. The fasteners can be bolts that are each securable with a nut.

The method can include installing a plurality of clevises on inside surfaces of the thruster well wall. A clamp can be engaged thereto, such as through a linkage member on of the plurality of clevis. The clevises can be formed from steel, stainless steel, or another material.

From about three to about forty clamps can be used around a thruster in a thruster well. Each clamp can have an actuator adapted to extend and retract using, for example, a hydraulic cylinder, a pneumatic cylinder, a screw jack, or an electrical clamp. Each clamp can have a linkage connected to the actuator for engagement with one of the clevis.

The method can include holding the clamps in an open or de-actuated position during normal thruster operation, and during removal of the thrusters, each clamp can be closed or actuated for securing the thruster mounting flange to the thruster well bottom flange while compressing the at least one seal. The seal can be an o-flange of elastomeric material. With the clamps closed, the fasteners can be removed.

A lifting means, which can have a connector secured to a flexible lift line, can be used to engage the lifting eye of the thruster or other portions of the thruster. The connector can be a hook or shackle. In one or more embodiments, the flexible lift line can be a cable, rope, or chain.

Once engaged, the lifting means, which can be a bridge crane, a hoist, or a removable lifting means, can be actuated to lift out of the thruster well a portion of the thruster that can be adversely affected by water, such as an electric motor.

The method can include transporting the thruster or the portion of the thruster using a moveable transport device connected to the lifting means. The moveable transport device can be a rolling trolley which can, in sequence, pick up and deposit to a deck of the floating vessel those portions of each thruster that can be adversely affected by water. In one or more embodiments, portions of each thruster which can be adversely affected by water can include the electric motor and the connecting shaft for the thruster.

The plurality of clamps can be actuated to compress at least one seal between the thruster mounting flange and the thruster well bottom flange. Once the seal is compressed and the plurality of fasteners are removed, water can be flowed into the thruster well to a maintenance level which can be below the top of the thruster well. In an embodiment, the thruster well can be filled about 50 percent full to equalize pressure around the thruster.

The thruster can be connected to the connector of the lifting means and the thruster can be raised with the hoist or other lifting means from the thruster well. For transit of the vessel, the lifting means can hold the thruster up and out of the water, and the hole in which the thruster came through can be capped with a bottom cover. Also, the thruster can be lifted and then lowered to a maintenance deck for transit, running, or for being towed.

For maintenance of the thruster, once the thruster is lifted, the thruster can be lowered to the deck for maintenance which can be adjacent the thruster well. There, on the maintenance deck, the thruster can be serviced and parts can be replaced.

The thruster, once serviced, can be lifted from the deck by the lifting means and then lowered into the thruster well. Alignment guides can be attached to inside edges of the thruster well and used to position the thruster in the thruster well in a proper position on the thruster well bottom flange. The thruster can be positioned off-center from a central axis of the thruster well. Alignment pins can be used to provide fine alignment of the thruster onto the thruster mounting flange. An index guide can be used to provide fine alignment of the thruster in the thruster well and over the thruster well bottom flange.

Once the thruster is aligned, the plurality of clamps can be actuated to compress at least one seal, or two concentric seals, to secure the thruster mounting flange against the thruster well bottom flange. After compressing the seal, the water can be pumped out of the thruster well. The water can be ballast water held in a reservoir of the vessel, or can be sea water pumped in through a thru hull fitting or conduit that extends into the water surrounding the floating vessel.

When the thruster well has been drained of water, a maintenance person can enter the thruster well, or a robot can extend into the thruster well, and the plurality of fasteners can be re-installed to hold the thruster mount flange to the thruster well bottom flange. Once the fasteners are installed, the plurality of clamps can be disengaged or de-actuated and left in an open position.

The method can include using a spreader bar with a spreader bar connector or a sling with a sling connector to engage the connector of the lifting means that can in-turn engage the at least one lifting eye of the thruster.

In embodiments of the method using at least one index guide to guide the thruster into the thruster well, all of the index guides can be connected to the inside surface of the thruster well wall, and can be used to further fit or clock the thruster into a correct orientation on the thruster well bottom flange. In one or more embodiments, at least one alignment guide can be used as an index guide.

In one or more embodiments, the alignment pins can be tapered. The method can include the use of more clamps than are needed, and each clamp can be selected to sustain the load of two clamps in the event of failure of an adjacent clamp. In one or more embodiments, clamp style nuts can be used to facilitate rapid fastening and un-fastening of the thruster to the thruster well bottom flange and to minimize the time that humans have to be in the thruster well. A hydraulic tool can be used with the clamp style nuts for super fast removal and reinstall, such as in less than twenty seconds per nut.

In one or more embodiments, the method can include using a manipulator to transport the thruster along the inside surface of the thruster well wall. The manipulator can be used to clamp onto the thruster and to support the thruster as the manipulator moves from a bottom position to a thruster well wall top. The manipulator can be used along the inside surface of the thruster well wall of the thruster well, such as on a pair of rails mounted to an inner side of the thruster wall. In one or more embodiments, the manipulator can be a hydraulic carriage with load supporting hinged or pivotable clasping arms. In one or more embodiments, remote controlled robotic arms can be installed on the manipulator and can be used to position the thruster for easy maintenance access. The robot arms can be controlled from a wireless remote device connected to a network.

In one or more embodiments, when the actuator is a hydraulic cylinder or a pneumatic cylinder, a rod can be used that can be slid in and out of the hydraulic or pneumatic cylinder along a central axis, thereby powering the linkage to compress the seal, sealing the thruster mount flange to the thruster mount flange, and deactivating the linkage compression.

The method can include using from about three to about one hundred alignment guides in each thruster well. A second lifting means can be used with the first lifting means, thereby enabling both lifting means to rotate and to position the thruster for easy maintenance access. The second lifting means can be removably installed on the vessel.

In one or more embodiments, from about three to about forty clams can be used, and from about three to about forty clevises can be used in each thruster well.

The method may include placing a top cover over the thruster well for allowing storage of those portions of the thruster which can be adversely affected by water, or any other part of the thruster, such as tools, maintenance equipment, or paint brushes. Similarly, a bottom cover can be installed over an opening formed in the thruster well bottom flange while the thruster is removed from the thruster well.

The method can include connecting the manipulator to a power supply for lifting and turning the thruster, and slidingly attaching the manipulator to at least one rail, wherein the at least one rail is affixed to the inside surface of the a thruster well wall and extends from the thruster well bottom flange to the thruster well wall top.

The method can include using an actuator including a hydraulic cylinder with a hydraulic power unit fluidly connected thereto through a hydraulic feed line to power the hydraulic cylinder.

A pressure washer can be connected to a conduit for providing water from a water reservoir, which can be used to allow for wash down of at least a portion of the thruster.

In one or more embodiments, a power tool can be used to quickly install and remove the plurality of fasteners, thereby allowing individual fastening removal in less than one minute. The power tool can be a hydraulic, pneumatic, or electric tool. For example, a hydraulic stud tensioner can be used as the power tool.

In one or more embodiments the thrusters can be positioning thrusters.

In one or more embodiments can including simultaneously actuating of each of the plurality of clamps to hold the thruster mounting flange against the thruster well bottom flange.

In one or more embodiments can include removing humans from the thruster well prior to flooding the thruster well with water. In one or more embodiments, after pumping the water out of the thruster well, humans can be allowed to enter the thruster well to install the plurality of fasteners.

The lifted thruster can be lowered to a deck for maintenance. During lowering of the thruster back into the thruster well, alignment guides can be used to position the thruster in the thruster well, wherein the thruster can be offset from and not in alignment with a central axis of the thruster well.

The method can include cladding the thruster well bottom flange with stainless steel or another corrosion resistant material. The cladding can be 1/16 to 1/4 inch in thickness. The cladding can be of the mating surface, that is, cladding on the surface that mates with the thruster mounting flange. The thruster mounting flange can be stainless steel, a stiff material, a corrosion resistant material, or combinations thereof. The thruster well bottom flange can be clad as well on the surfaces that mate with the thruster mounting flange, which can also be clad.

The method can include using at least one test port formed in the thruster mounting flange to provide a means for verifying that a water tight connection exists between the thruster well bottom flange and the thruster mounting flange. Four test ports equidistantly disposed around the thruster can be used in an embodiment. The test port can be used to test the inner seal regardless of the presence of or lack thereof of multiple seals.

An example of how the method described herein might be implemented using a system is provided. Operation of the system to implement the method can include the following step: form a thruster well in the bottom of a floating vessel around an opening in the bottom of the hull through which a thruster is mounted; optionally clad at least a portion of the thruster well bottom flange; install a plurality of alignment guide plates on an inside surface of the thruster well; optionally, clad the thruster mounting flange on the portions where it mates with the thruster well bottom flange; position at least one seal adjacent the thruster mounting flange; install a plurality of fasteners to secure the thruster mounting flange to the thruster well bottom flange; form a plurality of clevises on an inside surface of the thruster well wall; use clamp style nuts to facilitate rapid fastening and unfastening of the thruster to the thruster well bottom flange; fasten a plurality of clamps around the thruster and to clevises in the thruster well; optionally, use a rod for engaging the linkage; maintain the clamps in an open position; use a lifting means to engage a thruster or portion of a thruster; optionally, use a spreader bar to engage the thruster; lift portions of the thruster that may be adversely affected by water; transport the lifted thruster or portions of the thruster while lifted to a deck for repair; actuate the plurality of clamps to hold the thruster mounting flange against the thruster well bottom flange to compress the seal; remove the fasteners while the clamps are actuated; remove humans, if any are in the thruster well; flood the thruster well with water; disengage the plurality of clamps; lift the thruster with the lifting means when the thruster well is flooded with water; move the lifted thruster while lifted to a deck; after maintenance, position the lifted thruster over the thruster well; lower the thruster into the thruster well using the alignment guides; optionally, further guide the thruster onto the thruster mounting flange using at least one index guide; actuate the plurality of clamps to compress the seal; use alignment pins to provide fine alignment of the thruster onto the thruster mounting flange; pump the water from the thruster well, and allow humans or robots into the thruster well; reinstall the fasteners on the thruster mounting flange to hold it to the thruster well bottom flange with the humans or robots; use at least one test port to verify the water tight connection; if the seal is tight, disengage the clamps; optionally, use a manipulator to raise or lower the thruster while the manipulator is connected to a power supply; optionally use robot arms to raise and lower the thruster; optionally, use a second lifting means to position a thruster while holding the thruster with the first lifting means; place a top cover on the thruster well to provide storage; place a bottom cover over the hole in the thruster well bottom during floating vessel transit to keep water out of the vessel; use the clamps as connected to a power unit; optionally, use a pressure washer to wash down the thruster; and optionally, use a power tool to install and remove the fasteners.

Turning now to the figures, FIG. 1A depicts a first view of the system used in a first step of a sequence for lifting a thruster 6 with a human 96 in the thruster well 18. The thruster 6 is shown proximate a vessel hull bottom 82, such as a hull bottom of a floating vessel in the thruster well 18.

A lifting means 14 is shown disposed opposite the thruster 6, which can be an electric, hydraulic, or pneumatic hoist. Also depicted are a lifting eye 7, an electric motor 25 of the thruster 6, a hydraulic power unit 78, a hydraulic feed line 80 in communication with the hydraulic power unit 78, and a clamp 24*a* in communication with the hydraulic feed line 80. For example, the clamp 24*a* can include a hydraulic cylinder in communication with the hydraulic feed line 80. The clamps 24*a* and 24*b* are shown in actuated positions. The human 96 is shown with a power tool 92. In one or more embodiments, the lifting eye 7 can be welded to the thruster 6 in an L-shaped configuration, with the lifting means 14 securing to one side of the lifting eye 7 for lifting the thruster 6 or portions of the thruster.

Figure 1B:
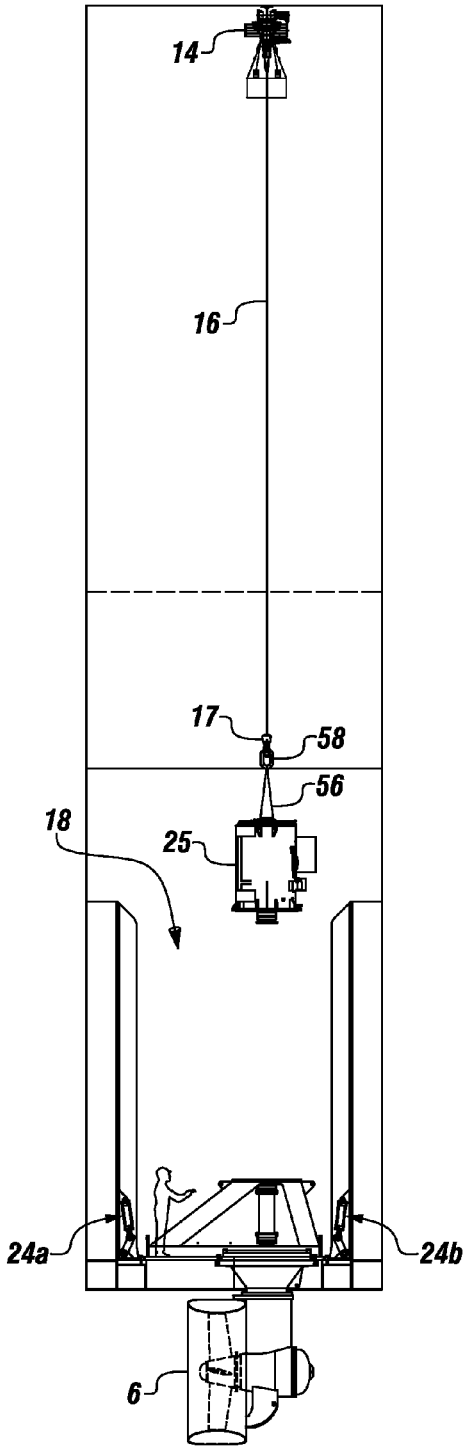
FIG. 1B is a second step of a sequence for lifting a thruster with an electric motor hoisted out of the thruster well.

FIG. 1B depicts another view of the system showing a second step in the sequence for lifting a portion of the thruster 6. The electric motor 25, which powers the thruster 6, is shown being hoisted out of the thruster well 18.

The lifting means 14 can be connected to a flexible lift line 16, which can be a cable. A connector 17, which can be a hook, can be connected to the flexible lift line 16 opposite the lifting means 14. The connector 17 can also be connected to a sling connector 58 which can be connected to a sling 56. The sling 56 can be connected to the electric motor 25 for lifting the electric motor 25. Also depicted are the clamps 24*a* and 24*b* in non-actuated positions. During the stage of operation depicted, the thruster well 18 can be devoid of water.

Figure 1C:
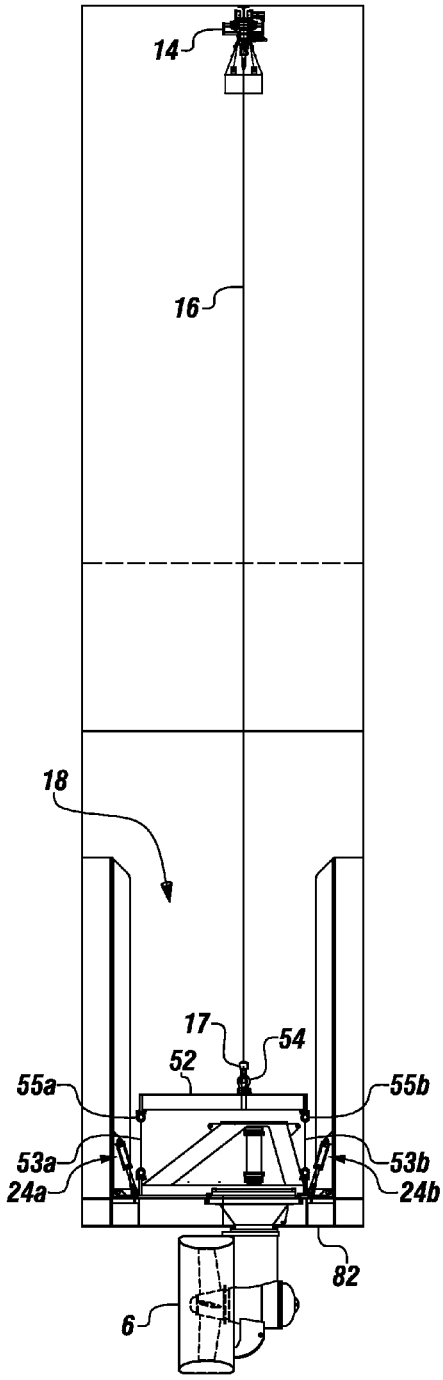
FIG. 1C is a first alternative embodiment of a step of the method for lifting at least a portion of the thruster using a deployed spreader bar in the thruster well.

FIG. 1C shows another embodiment of the system depicting a deployed spreader bar 52 with a plurality of flexible members 53*a* and 53*b* in the thruster well 18. Each flexible member 53*a* and 53*b* can be a cable and can have a connection, such as connections 55*a* and 55*b*, which can be shackles for engaging with the thruster 6 or with portions of the thruster in the thruster well 18. The spreader bar 52 can have a spreader bar connector 54 for engaging the connector 17 of the lifting means 14 and the flexible lift line 16. Also depicted are vessel hull bottom 82, and the clamps 24*a* and 24*d* in actuated positions.

Figure 1D:
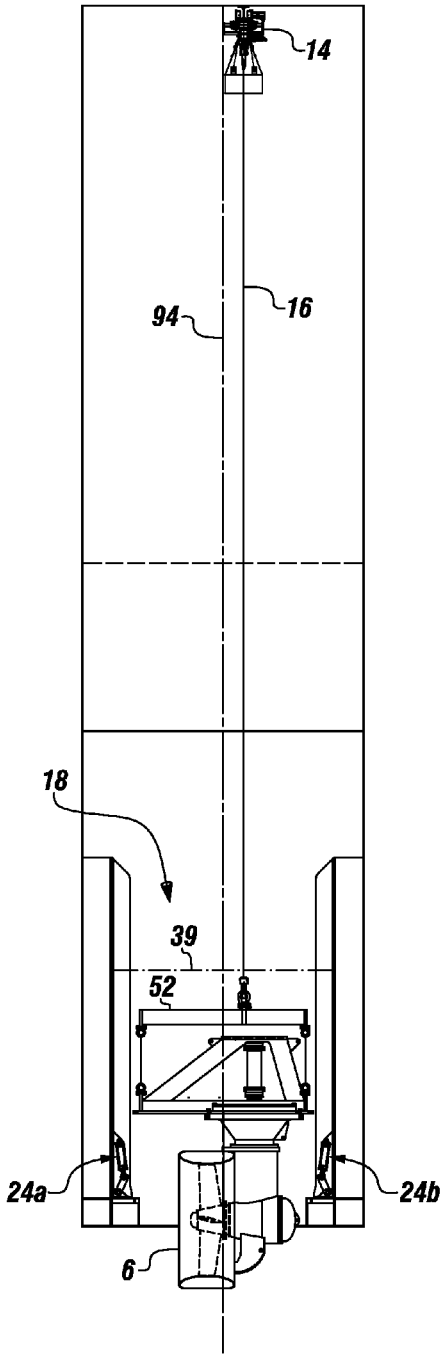
FIG. 1D is another step of the first alternative embodiment of the method, showing a slightly raised thruster hoisted using the spreader bar, and with the thruster well partially filled with water.

FIG. 1D depicts the thruster well 18 containing water 39. The clamps 24*a* and 24*b* are depicted in non-actuated positions. The lifting means 14 with the flexible lift line 16 has slightly raised the thruster 6 from the thruster well 18 using the spreader bar 52. By having the thruster well 18 at least partially filled with water 39, the pressure on the thruster 6 can be equalized with the water pressure outside of the floating vessel. The thruster 6 can be raised and placed on a deck of the floating vessel. The thruster 6 is depicted mounted off-center of a central axis 94 of the thruster well 18.

Figure 1E:
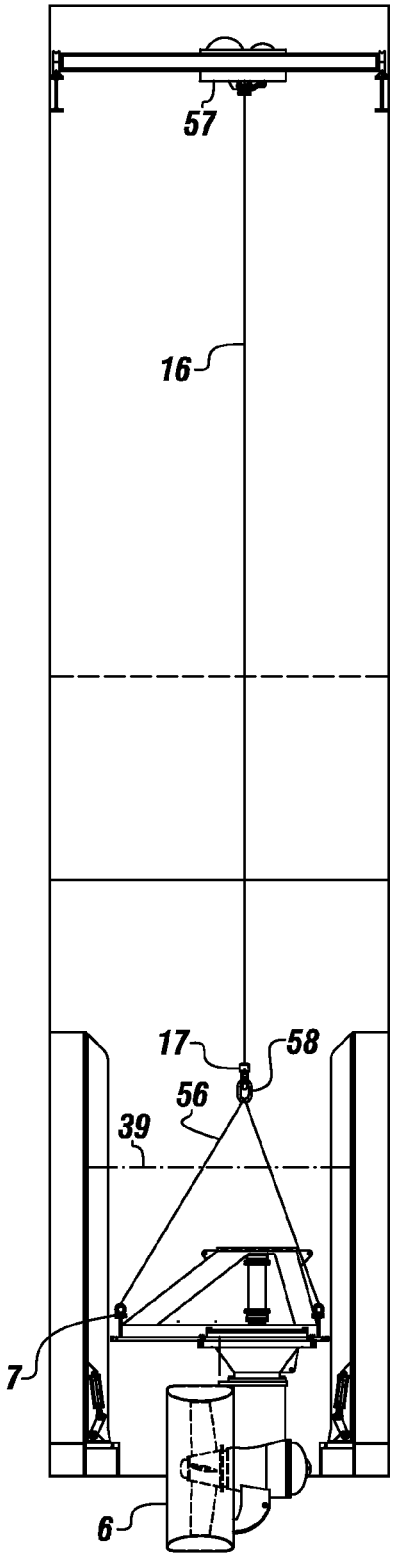
FIG. 1E depicts a bridge crane and sling that can be used for removing the thruster.

FIG. 1E depicts the system with a bridge crane 57 and sling 56 that can be used for removing the thruster 6. Also shown are the flexible lift line 16, the connector 17, the sling connector 58, the water 39, and the lifting eye 7 engaged with the sling 56.

Figure 2B:
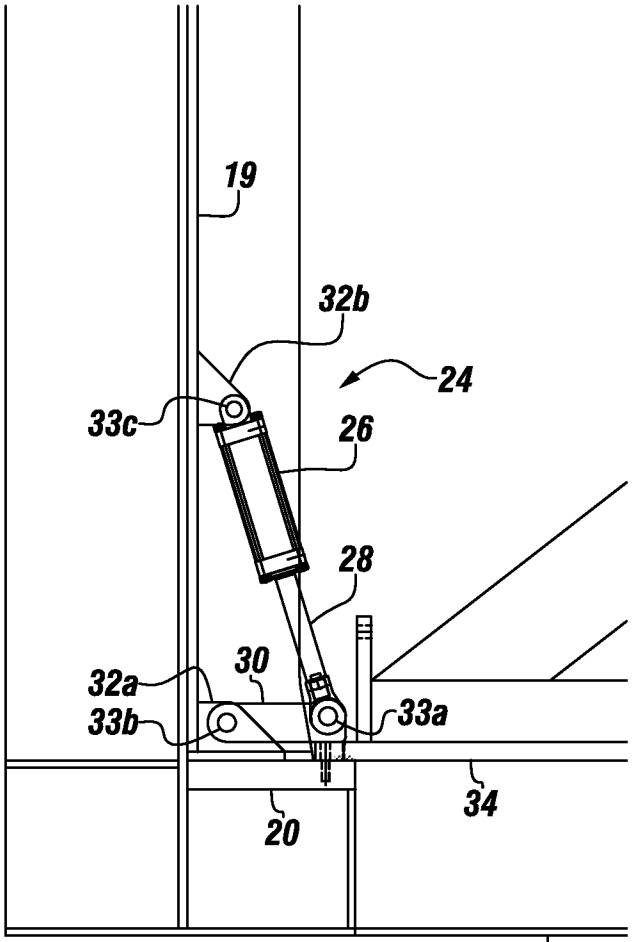
FIGS. 2A-2B is a detailed view of a clamp used to hold a thruster mounting flange to the thruster well bottom flange in two positions.
Figure 2A:
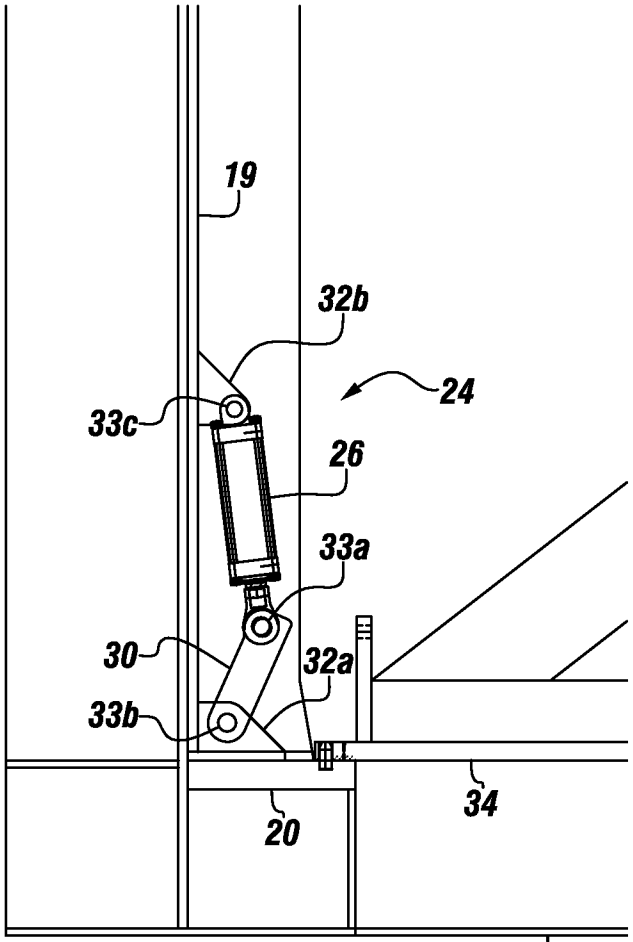

FIGS. 2A and 2B depict a detailed view of a clamp 24 used to hold a thruster mounting flange 34 to a thruster well bottom flange 20 near the vessel hull bottom 82. The clamp 24 is shown in a de-actuated position in FIG. 2A, and in an actuated position in FIG. 2B.

The clamp 24 can include an actuator 26, which can be a hydraulic cylinder, a pneumatic cylinder, a screw jack, or an electrical clamp. The actuator 26 can support a rod 28 that can slidingly engage the actuator 26. The rod 28 can connect to a pivoting linkage 30, such as with a first pin 33*a*. The pivoting linkage 30 can connect to a first clevis 32*a*, which can be connected to the thruster well wall 19. The first clevis 32*a* is shown having a polygon shape with a hole for supporting a second pin 33*b*, which can be a clevis pin that engages the pivoting linkage 30, and allows the pivoting linkage 30 to rotate about the second pin 33*b*. The actuator 26 can be connected to the thruster well wall 19 at a second clevis 32*b* with a third pin 33*c*, which can be a clevis pin.

The actuator 26 can be a cylinder with a piston that moves toward the vessel hull bottom 82 causing the pivoting linkage 30 to secure the thruster mounting flange 34 to the thruster well bottom flange 20.

Figure 3:
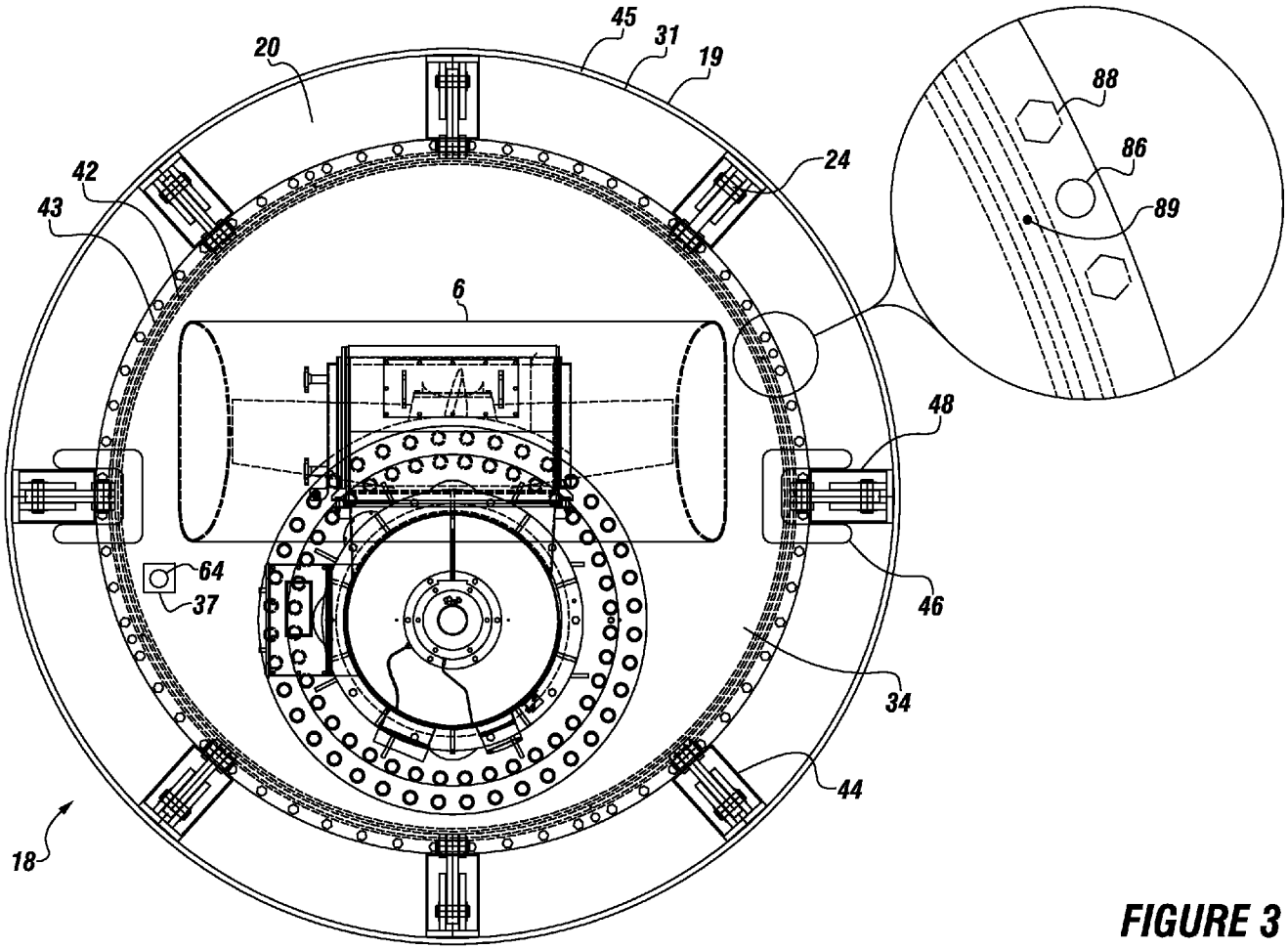
FIG. 3 is a top view of the thruster well with the clamps disposed around a top portion of the thruster usable in an embodiment of the method.

FIG. 3 is a top view of the thruster well with clamps disposed around a top portion of the thruster 6.

The thruster well 18 can be disposed about the thruster 6. The thruster well 18 can have a thruster well wall 19 with a thruster well wall top 45 and a thruster well bottom flange 20. The thruster well wall 19 can have an inside surface 31 to which can be attached a plurality of alignment guide plates, such as alignment guide plate 44.

A thru hull fitting 48 can be used to allow sea water to enter through the vessel hull bottom to the thruster well 18.

The system can include a plurality of test ports, such as test port 89, which can be disposed in the thruster mounting flange 34. A first seal 42 can be positioned adjacent the thruster mounting flange 34, and a second seal 43 can be concentrically disposed around the first seal 42.

A plurality of alignment pins, such as alignment pin 86, can provide for a fine alignment of the thruster 6 in the thruster mounting flange 34. The alignment pins can be cylinders of steel with diameters from about ½ inch and 3 inches. In embodiments, the alignment pins can be tapered on the end opposite the thruster mounting flange 34.

Fasteners, such as fastener 88, can bolt or fasten the thruster mounting flange 34 to the thruster well bottom flange 20.

Index guides, such as index guide 46, can fix rotation of the thruster 6. The index guides can be notches. The index guide 46 can be connected to the inside surface 31 of the thruster well wall 19.

Also shown is clamp 24, an in-flow controller 37 and an opening 64.

Figure 4:
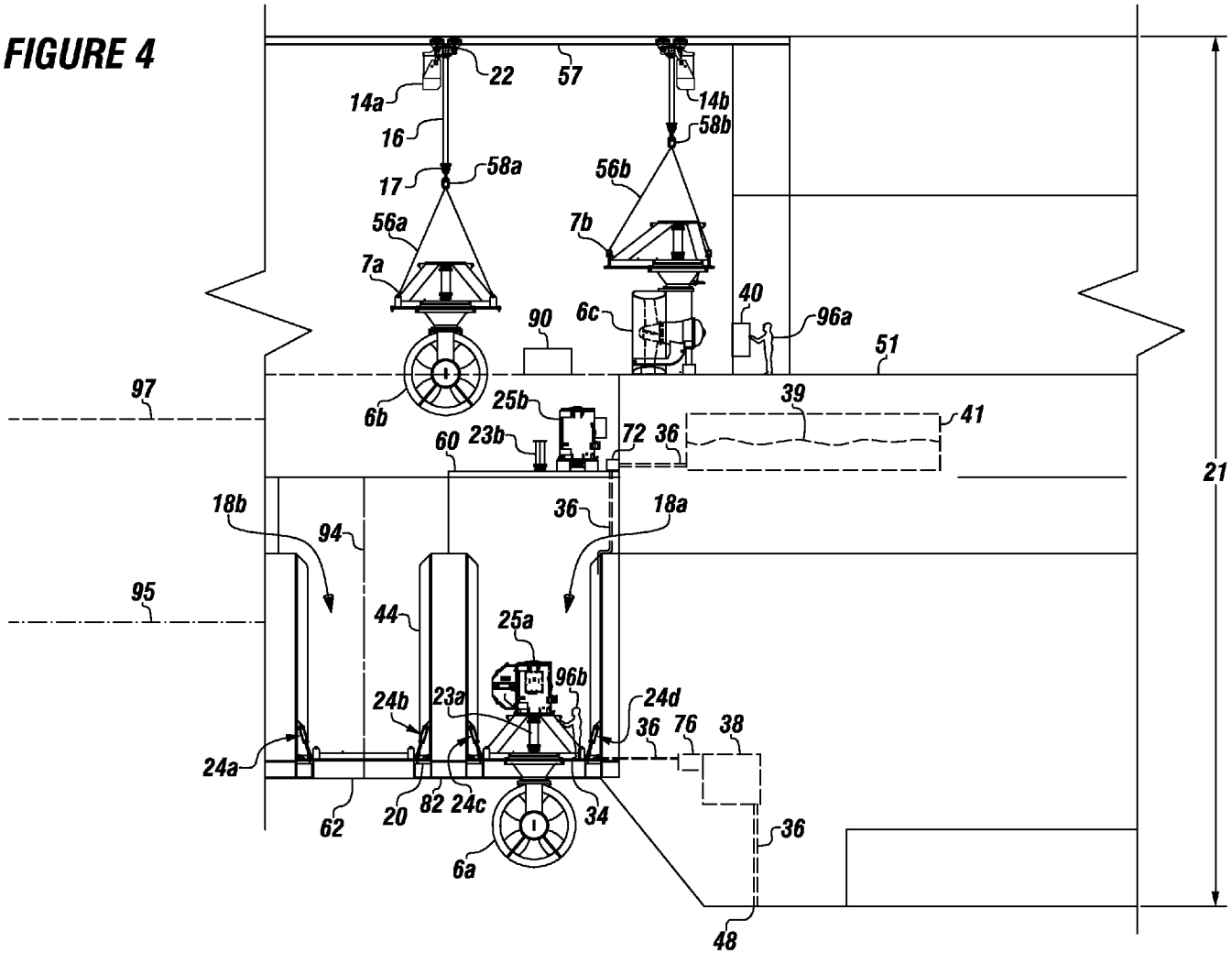
FIG. 4 is a view of three thrusters, one in a thruster well, a second thruster suspended above the thruster well held by a hoist, and a third thruster positioned on deck of a floating vessel for maintenance according to a step of an embodiment of the method.

FIG. 4 depicts three thrusters, thruster 6*a*, thruster 6*b*, and thruster 6*c*. Thruster 6*a* is disposed in a thruster well 18*a*. The thruster 6*b* is suspended above the thruster wells 18*a* and 18*b*, and is held by the lifting means 14*a*. The thruster 6*c* is shown on deck 51 of the floating vessel 21 and engaged with a second lifting means 14*b*.

The first lifting means 14*a* is shown connected to a moveable transport device 22 that can roll along a bridge crane 57. The second lifting means 14*b* is also depicted connected to the bridge crane 57. The first lifting means 14*a* can have a flexible lift line 16, a connector 17, a first lifting eye 7*a*, a first sling connector 58*a*, and a first sling 56*a*. The second lifting means 14*b* can have a second lifting eye 7*b*, a second sling connector 58*b*, and a second sling 56*b*.

A first human 96*a* is shown at a controller 40 for operating a pump 38 connected to a conduit 36. The pump 38 can pump water 39 from a water reservoir 41 through an in-flow valve 72 into the thruster wells 18*a* and 18*b*. An "in-flow" controller and an "out-flow" controller or a bidirectional controller can be used to move the water 39. The pump 38 can be in communication with a remote actuated controller 76. A thru hull fitting 48 can be opened or closed, such as with a valve, to allow sea water to enter the thruster wells. The thru hull fitting 48 can be in fluid communication with the pump 38. In operation, prior to allowing water 39 into the thruster wells, people can be evacuated from the thruster wells. The people can remove the fasteners from the thruster mounting flange after actuating the plurality of clamps.

A top cover 60 is shown mounted above the thruster well 18*a* onto which equipment can be mounted for use in repair of other thrusters 6*a*, 6*b*, 6*c*, such as a second electric motor 25*b* and a second connecting shaft 23*b* from the second thruster 6*b*.

In one or more embodiments, a remote control device or remote actuated controller can be used to remotely activate and de-activate the clamps 24*a*, 24*b*, 24*c*, 24*d*.

A pressure washer 90 can be used in the thruster wells to clean salt water off the thrusters.

Also depicted is a second human 96*b*, a first connecting shaft 23*a*, a central axis 94 of the thruster well 18*b*, a maintenance draught 95, and an operating draught 97. The maintenance draught 95 can be a level at which water is kept during maintenance of the thrusters, and the operating draught 97 can be a level at which water is kept during operations of the thrusters.

Also depicted is a thruster mounting flange 34, a thruster well bottom flange 20, a vessel hull bottom 82, a bottom cover 62, and an alignment guide plate 44.

Figure 5:
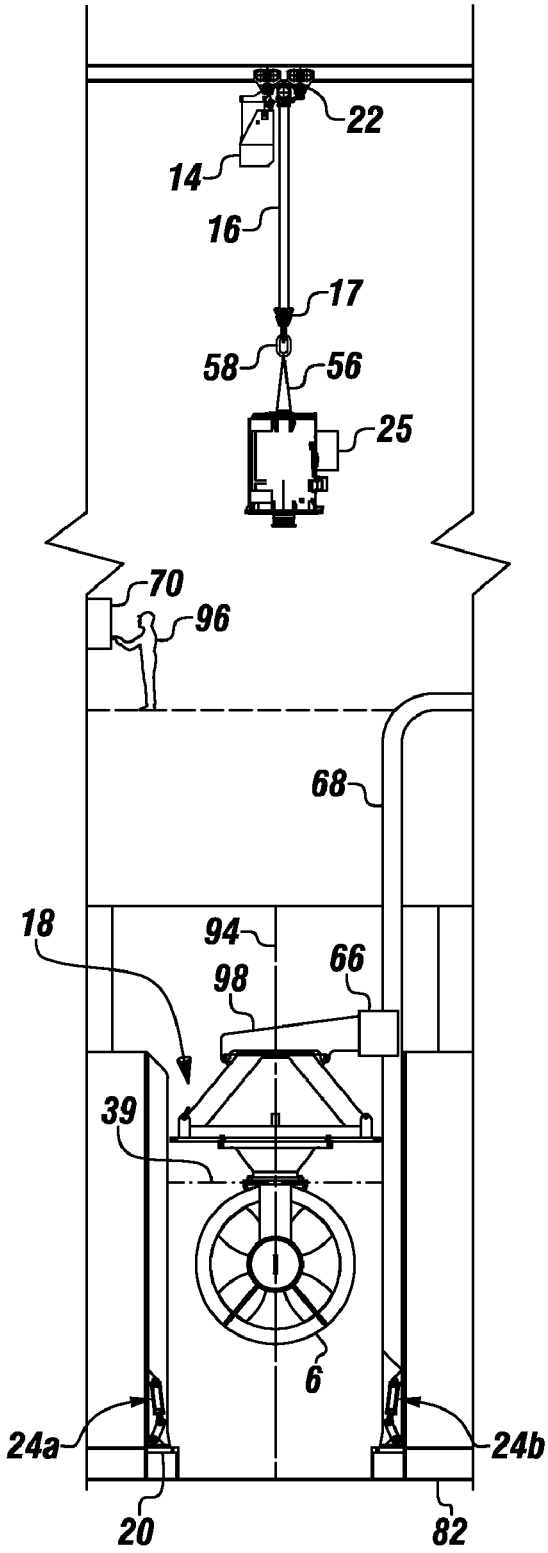
FIG. 5 is a view of a thruster well with a reach rod.

FIG. 5 is a side view of a thruster well 18 with clamps 24*a* and 24*b*, and a thruster 6. A human 96 is shown operating a power source 70.

The thruster well 18 is shown with a manipulator 66 disposed on a rail 68 that enables the manipulator 66 to slide up and down the rail, thereby raising and lowering the thruster 6. The manipulator 66 can have a robot arm 98 for engaging the thruster 6.

Also depicted are the moveable transport device 22, the lifting means 14, the flexible lift line 16, the connector 17, the sling connector 58, the sling 56, the electric motor 25, the central axis 94, the water 39, the thruster well bottom flange 20, and the vessel hull bottom 82.

Figure 6A:
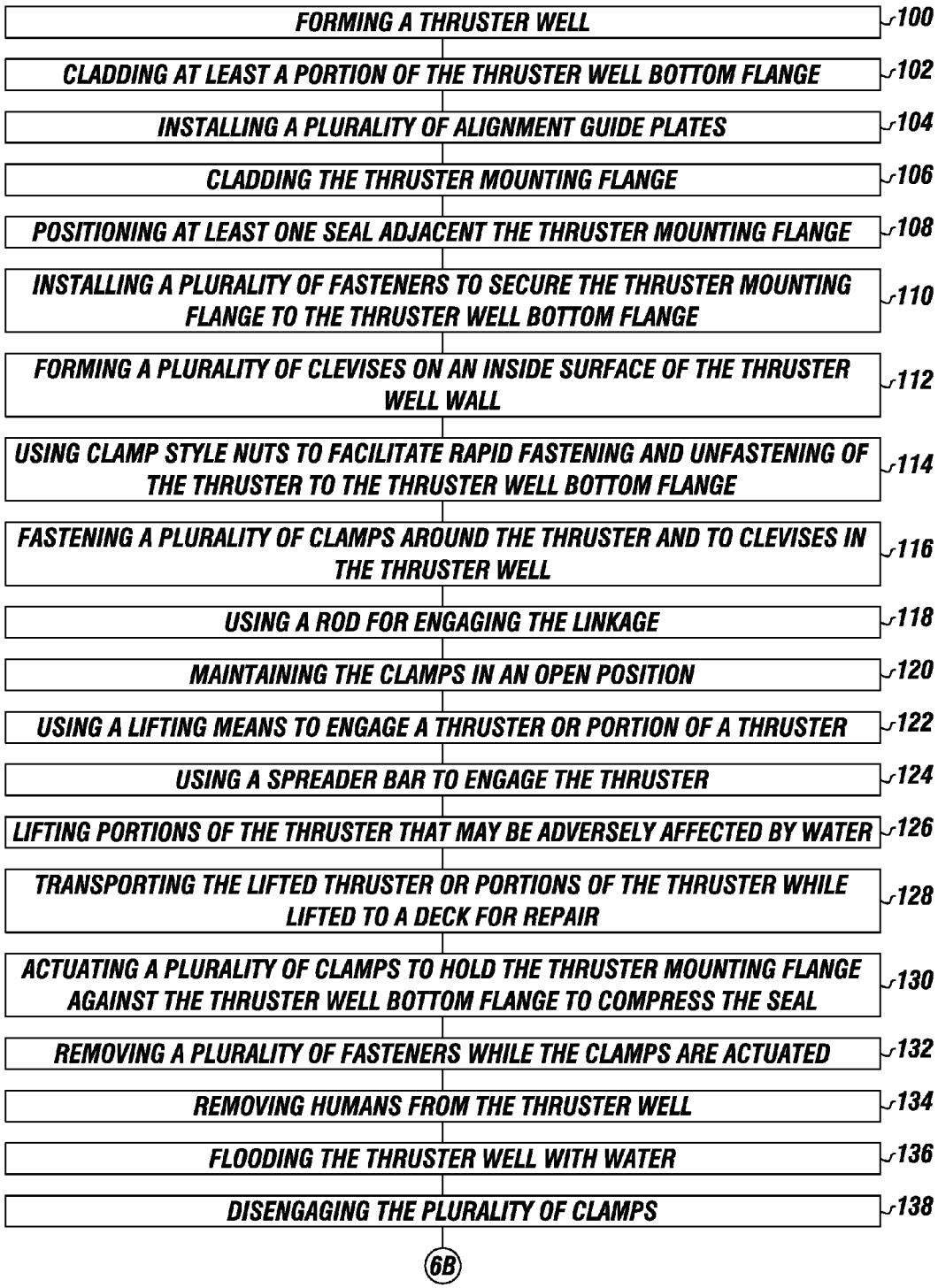
FIGS. 6A-6B depict an embodiment of steps of the method.
Figure 6B:
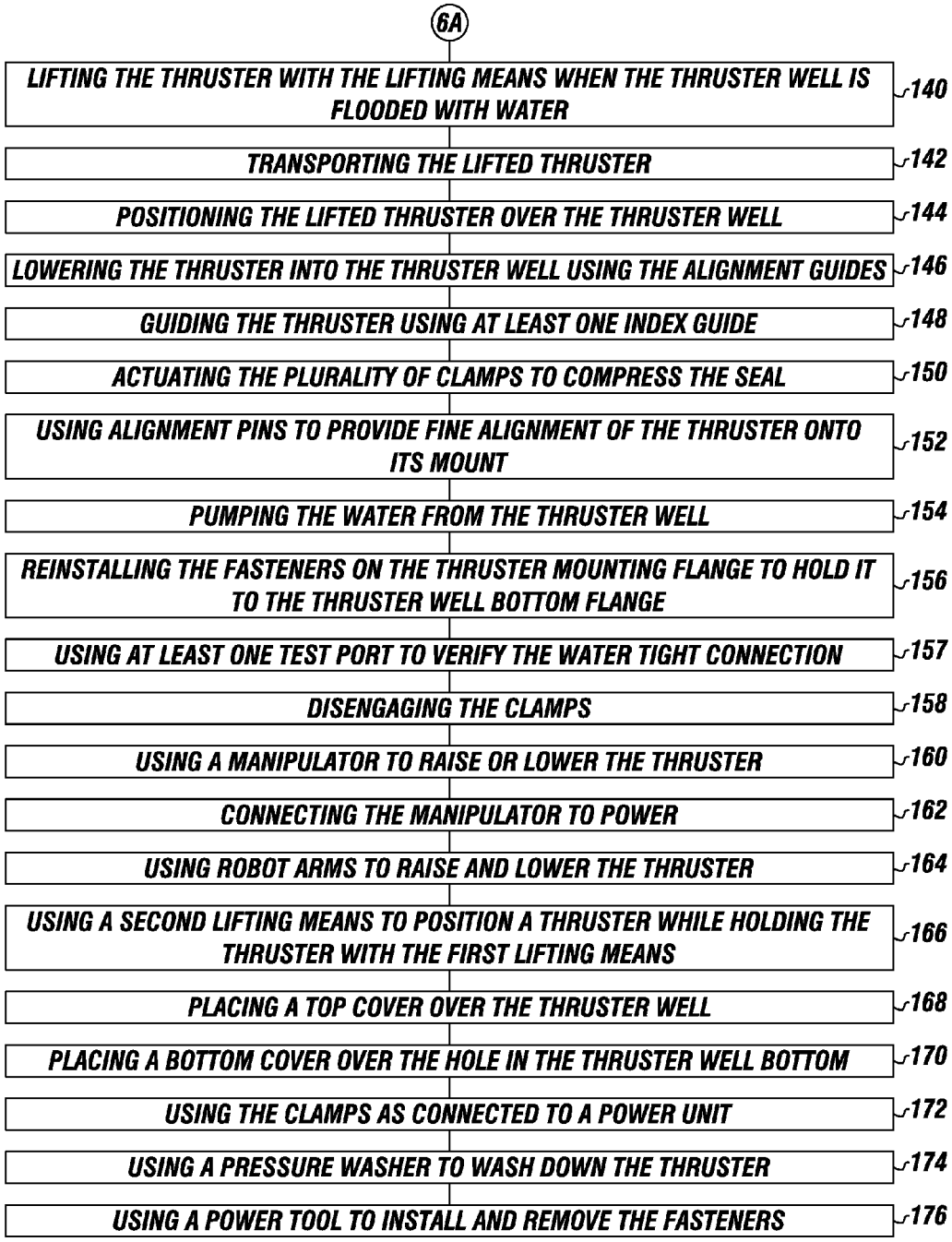

FIGS. 6A-6B depict an embodiment of steps of the method.

FIG. 6A shows that the method can include forming a thruster well, as illustrated by box 100.

The method can include cladding at least a portion of the thruster well bottom flange, as illustrated by box 102.

The method can include installing a plurality of alignment guide plates, as illustrated by box 104.

The method can include cladding the thruster mounting flange, as illustrated by box 106.

The method can include positioning at least one seal adjacent the thruster mounting flange, as illustrated by box 108.

The method can include installing a plurality of fasteners to secure the thruster mounting flange to the thruster well bottom flange, as illustrated by box 110.

The method can include forming a plurality of clevises on an inside surface of the thruster well wall, as illustrated by box 112.

The method can include using clamp style nuts to facilitate rapid fastening and unfastening of the thruster to the thruster well bottom flange, as illustrated by box 114.

The method can include fastening a plurality of clamps around the thruster and to clevises in the thruster well, as illustrated by box 116.

The method can include using a rod for engaging the linkage, as illustrated by box 118.

The method can include maintaining the clamps in an open position, as illustrated by box 120.

The method can include using a lifting means to engage a thruster or portion of a thruster, as illustrated by box 122.

The method can include using a spreader bar to engage the thruster, as illustrated by box 124.

The method can include lifting portions of the thruster that may be adversely affected by water, as illustrated by box 126.

The method can include transporting the lifted thruster or portions of the thruster while lifted to a deck for repair, as illustrated by box 128.

The method can include actuating a plurality of clamps to hold the thruster mounting flange against the thruster well bottom flange to compress the seal, as illustrated by box 130.

The method can include removing a plurality of fasteners while the clamps are actuated, as illustrated by box 132.

The method can include removing humans from the thruster well, as illustrated by box 134.

The method can include flooding the thruster well with water, as illustrated by box 136.

The method can include disengaging the plurality of clamps, as illustrated by box 138.

FIG. 6B is a continuation of FIG. 6A. The method can include lifting the thruster with the lifting means when the thruster well is flooded with water, as illustrated by box 140.

The method can include transporting the lifted thruster, as illustrated by box 142.

The method can include positioning the lifted thruster over the thruster well, as illustrated by box 144.

The method can include lowering the thruster into the thruster well using the alignment guides, as illustrated by box 146.

The method can include guiding the thruster using at least one index guide, as illustrated by box 148.

The method can include actuating the plurality of clamps to compress the seal, as illustrated by box 150.

The method can include using alignment pins to provide fine alignment of the thruster onto its mount, as illustrated by box 152.

The method can include pumping the water from the thruster well, as illustrated by box 154.

The method can include reinstalling the fasteners on the thruster mounting flange to hold it to the thruster well bottom flange, as illustrated by box 156.

The method can include using at least one test port to verify the water tight connection, as illustrated by box 157.

The method can include disengaging the clamps, as illustrated by box 158.

The method can include using a manipulator to raise or lower the thruster, as illustrated by box 160.

The method can include connecting the manipulator to power, as illustrated by box 162.

The method can include using robot arms to raise and lower the thruster, as illustrated by box 164.

The method can include using a second lifting means to position a thruster while holding the thruster with the first lifting means, as illustrated by box 166.

The method can include placing a top cover over the thruster well, as illustrated by box 168.

The method can include placing a bottom cover over the hole in the thruster well bottom, as illustrated by box 170.

The method can include using the clamps as connected to a power unit, as illustrated by box 172.

The method can include using a pressure washer to wash down the thruster, as illustrated by box 174.

The method can include using a power tool to install and remove the fasteners, as illustrated by box 176.

While these embodiments have been described with emphasis on the embodiments, it should be understood that within the scope of the appended claims, the embodiments might be practiced other than as specifically described herein.

What is claimed is:

1. A method for lifting thrusters on floating vessels for floating vessel transit, for floating vessel dry docking, for thruster maintenance, or combinations thereof, the method comprising:

a. forming a thruster well with a thruster well wall and a thruster well bottom flange for engagement with a thruster mounting flange of a thruster, wherein the thruster at least partially extends into water through a hull of a floating vessel;

b. installing a plurality of alignment guide plates concentrically around the thruster in the thruster well, wherein each alignment guide plate extends from proximate the thruster well bottom flange to a thruster well wall top of the thruster well wall to provide a rough alignment of the thruster mounting flange to the thruster well bottom flange;

c. positioning a least one seal adjacent the thruster mounting flange to provide a water tight connection between the thruster well bottom flange and the thruster mounting flange;

d. installing a plurality of fasteners to secure the thruster mounting flange to the thruster well bottom flange while compressing the at least one seal;

e. forming a plurality of clevises on an inside surface of the thruster well wall;

f. fastening a plurality of clamps to the thruster well wall using the plurality of clevises, wherein each clamp has an actuator adapted to extend and retract and a linkage connected to the actuator;

g. maintaining each of the clamps in an open position during normal thruster operation, and during removal of the thruster: actuating each clamp to extend to a closed position to secure the thruster mounting flange to the thruster well bottom flange while compressing the at least one seal;

h. lowering a flexible lift line and a connector of a lifting means into the thruster well, and engaging the connector with a lifting eye of the thruster or with a lifting eye of a portion of the thruster;

i. raising the thruster or the portion of the thruster out of the thruster well using the lifting means;

j. transporting the thruster or the portion of the thruster using a moveable transport device connected to the lifting means to a deck of the floating vessel;

k. actuating each of the plurality of clamps to extend to hold the thruster mounting flange against the thruster well bottom flange and to ensure that the at least one seal remains compressed, and while the clamps are actuated, removing the plurality of fasteners that secure the thruster mounting flange to the thruster well bottom flange;

l. flooding the thruster well with water;

m. disengaging the plurality of clamps; and n. lifting the thruster with the lifting means.

2. The method of claim 1, further comprising:

a. positioning the lifted thruster over the thruster well;

b. lowering the lifted thruster into the thruster well using the lifting means and the plurality of alignment guide plates to position the thruster in the thruster well on the thruster well bottom flange;

c. actuating the plurality of clamps to compress the at least one seal to secure the thruster mounting flange against the thruster well bottom flange;

d. pumping the water out of the thruster well;

e. installing the plurality of fasteners that secure the thruster mounting flange to the thruster well bottom flange; and f. disengaging the plurality of clamps.

3. The method of claim 2, further comprising additionally guiding the thruster into the thruster well using at least one index guide connected to the inside surface of the thruster well wall to fit the thruster into a correct orientation on the thruster well bottom flange.

4. The method of claim 1, further comprising using a spreader bar with a spreader bar connector or using a sling with a sling connector to engage the connector and to additionally engage the lifting eye of the thruster.

5. The method of claim 4, further comprising using alignment pins in the thruster well bottom flange to refine a position of the thruster as the thruster is lowered to the thruster well bottom flange.

6. The method of claim 1, further comprising using at least one alignment guide plate as an index guide.

7. The method of claim 1, further comprising using clamp style nuts to facilitate rapid fastening and un-fastening of the thruster to the thruster well bottom flange and to minimize time that humans have to be in the thruster well.

8. The method of claim 1, further comprising using a manipulator to transport the thruster, wherein the manipulator clamps onto the thruster and moves toward the thruster well wall top along the inside surface of the thruster well wall while supporting the thruster.

9. The method of claim 8, further comprising:

a. connecting the manipulator to a power supply to lift and turn the thruster;

b. slidingly attaching the manipulator to at least one rail, wherein the at least one rail is affixed to the inside surface of the thruster well wall and extends from proximate the thruster well bottom flange to the thruster well wall top; and c. using robot arms with the manipulator to position the thruster for easy maintenance access.

10. The method of claim 1, further using a rod to engage each linkage, wherein each actuator is a hydraulic cylinder or a pneumatic cylinder.

11. The method of claim 1, further comprising:

a. using a second lifting means to position the thruster for easy maintenance access;

b. using from three to one hundred alignment guide plates in the thruster well;

c. using from three to forty clamps in each thruster well;

d. using from three to forty clevises in each thruster well; or e. combinations thereof.

12. The method of claim 1, further comprising:

a. placing a top cover over the thruster well; and b. installing a bottom cover over an opening formed in the thruster well bottom flange while the thruster is removed from the thruster well.

13. The method of claim 1, wherein each actuator comprises a hydraulic cylinder, the method further comprising: powering and actuating the hydraulic cylinder using a hydraulic power unit fluidly connected to the hydraulic cylinder through a hydraulic feed line.

14. The method of claim 1, further supplying the water to the thruster well from a water reservoir, and thereby equalizing a water pressure in the thruster well with a water pressure outside the floating vessel.

15. The method of claim 14, further comprising using a pressure washer connected to a conduit fluidly connected to the water reservoir to wash down the thruster.

16. The method of claim 1, further comprising, during the lowering of the thruster into the thruster well, using the lifting means and the alignment guide plates to position the thruster in the thruster well offset to a central axis of the thruster well.

17. The method of claim 1, further comprising:

a. cladding the thruster well bottom flange with stainless steel or another corrosion resistant material; and b. cladding the thruster mounting flange with stainless steel or another corrosion resistant material.

18. The method of claim 1, further comprising using at least one test port to test the at least one seal to verify the water tight connection.

19. A method for lifting thrusters on floating vessels for floating vessel transit, for floating vessel dry docking, for thruster maintenance, or combinations thereof, the method comprising:

a. engaging a thruster mounting flange of a thruster with a thruster well bottom flange of a thruster well;

b. installing a plurality of alignment guide plates concentrically around the thruster in the thruster well to provide a rough alignment of the thruster mounting flange to the thruster well bottom flange;

c. positioning a least one seal adjacent the thruster mounting flange to provide a connection between the thruster well bottom flange and the thruster mounting flange;

d. installing a plurality of fasteners to secure the thruster mounting flange to the thruster well bottom flange while compressing the at least one seal;

e. maintaining a plurality of clamps attached to the thruster well in an open position during normal thruster operation, and during removal of the thruster: actuating each clamp to extend to a closed position to secure the thruster mounting flange to the thruster well bottom flange while compressing the at least one seal;

f. using a lifting means to raise the thruster or a portion of the thruster out of the thruster well;

g. transporting the thruster or the portion of the thruster using a transport device connected to the lifting means to a deck of the floating vessel;

h. actuating each of the plurality of clamps to extend to hold the thruster mounting flange against the thruster well bottom flange and to ensure that the at least one seal remains compressed;

i. while the clamps are actuated, removing the plurality of fasteners that secure the thruster mounting flange to the thruster well bottom flange;

j. flowing water into the thruster well;

k. disengaging the plurality of clamps; and l. lifting the thruster with the lifting means.

20. The method of claim 19, further comprising:

a. positioning the lifted thruster over the thruster well;

b. lowering the lifted thruster into the thruster well using the lifting means and the plurality of alignment guide plates to position the thruster in the thruster well on the thruster well bottom flange;

c. actuating the plurality of clamps to compress the at least one seal to secure the thruster mounting flange against the thruster well bottom flange;

d. flowing the water out of the thruster well;

e. installing the plurality of fasteners to secure the thruster mounting flange to the thruster well bottom flange; and f. disengaging the plurality of clamps.

* * * * *